United States Patent [19]

Wang et al.

[11] Patent Number: 5,052,683

[45] Date of Patent: Oct. 1, 1991

[54] BOXING TRAINING PARTNER

[76] Inventors: Chuan M. Wang; Chuan S. Wang, both of No. 3, Alley 12, Lane 188, Tung Nan St., Hsin Chu City, Taiwan

[21] Appl. No.: 514,247

[22] Filed: Apr. 25, 1990

[51] Int. Cl.[5] ..... A63B 69/00

[52] U.S. Cl. ..... 272/76; 272/129; 272/130; 272/DIG. 4; 434/392; 446/180; 446/199; 273/458

[58] Field of Search ..... 272/64, 76, 78, 93, 272/94, 129, 130, DIG. 4, 77; 434/247, 392; 73/379; 446/180, 183, 198, 199, 268, 320, 325; 273/1 L, 85 B, 857, 85 E; 901/22

[56] References Cited

U.S. PATENT DOCUMENTS

| | | | |
|---|---|---|---|
| 243,456 | 6/1881 | Medart | 272/64 |
| 4,088,315 | 5/1978 | Schemmel | 272/76 |
| 4,387,893 | 6/1983 | Baldwin | 272/134 X |
| 4,522,394 | 6/1985 | Broussard | 272/78 X |
| 4,609,195 | 9/1986 | Ham | 273/85 F |
| 4,765,609 | 8/1988 | Wilson et al. | 272/76 |

FOREIGN PATENT DOCUMENTS

| | | | |
|---|---|---|---|
| 0173129 | 3/1986 | European Pat. Off. | 272/76 |

*Primary Examiner*—Richard J. Apley
*Assistant Examiner*—Joe H. Cheng
*Attorney, Agent, or Firm*—Morton J. Rosenberg; David I. Klein

[57] ABSTRACT

A boxing training partner comprised of a base, a figure body having two arms, a spring, a height adjusting device located in the base, a controller, and two arm extension devices. The controller controls the filling of gas bags, which are part of the arm extension devices, for causing the two arms to extend aperiodically, according to a predetermined sequence stored in a memory, so as to respectively give a blow. A pair of arch spring plates are placed in each of the two arms, for returning the two arms to their retracted position, each time after having been extended.

1 Claim, 6 Drawing Sheets

BOXING TRAINING PARTNER

BACKGROUND OF THE INVENTION

The present invention is related to a boxing training partner which utilizes an electronic controller to control two arms to aperiodically extend and retract so as to imitate the action of a sparring partner in a boxing game.

In training for boxing, it is best to have a sparring partner to exercise with. If no sparring partner is available, one can only train with a body bag to exercise one's muscles, and cannot enjoy counter punching. In consequence, one will easily become bored with training.

The main object of the present invention is to provide such a boxing training partner, which includes gas bags and spring plates within the arms to control the stretching and contracting thereof, an electronic controller to control the timing and the strength of the two arms in striking a blow.

Another object of the present invention is to provide such a boxing training partner wherein the height of the training partner can be readily adjusted to approximate the body height of a player.

A yet further object of the present invention is to provide such a boxing training partner in which the controller can control the frequency of blows within a unit of time.

Figure 4:
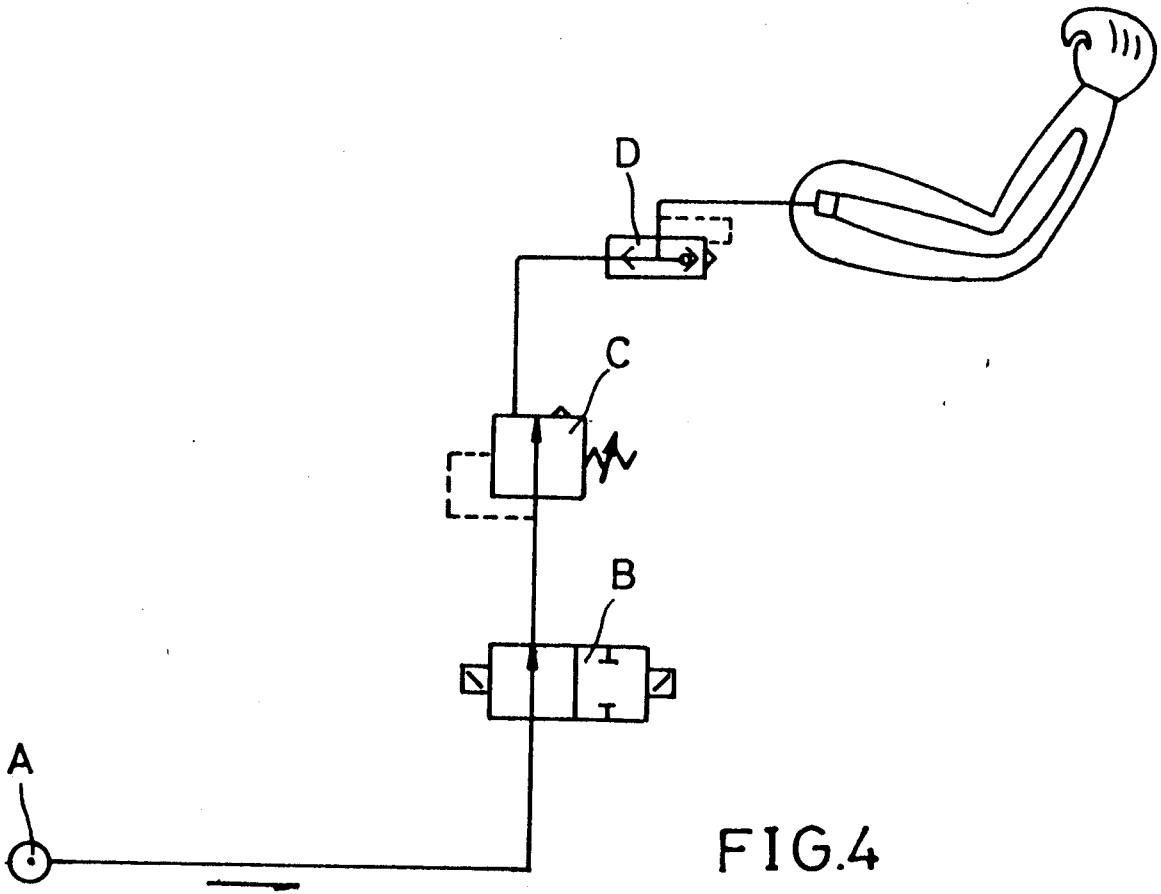
Figure 5:
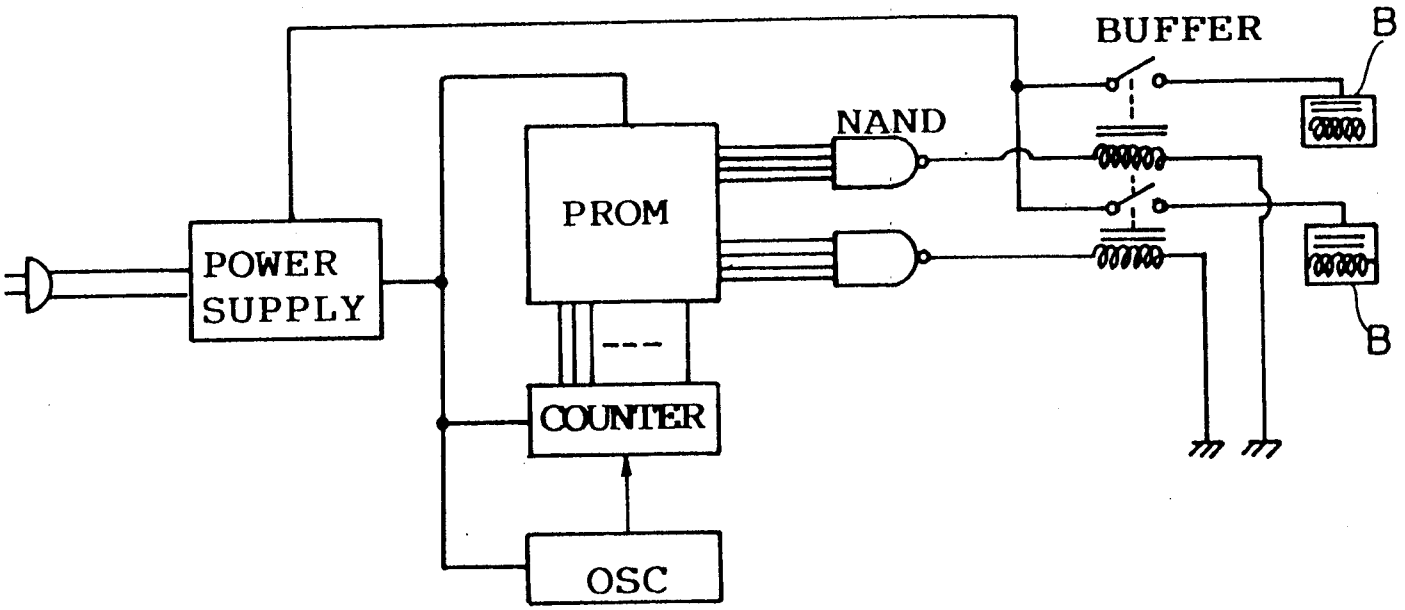
Figure 6:
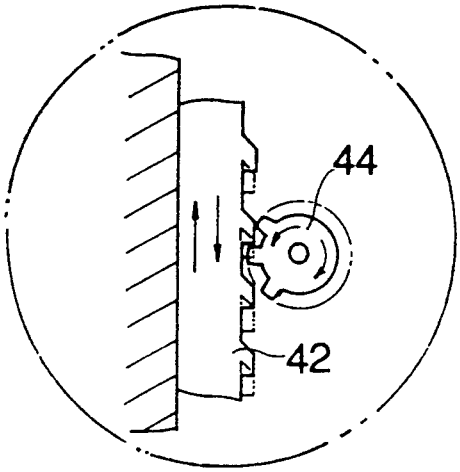
Figure 7:
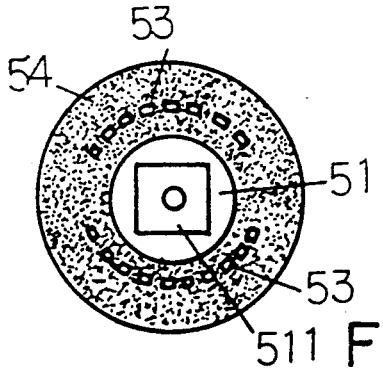

FIG. *2a* is a structural schematic view of the arms;

FIG. *2b* is a structural schematic view of an arm in the extended position;

FIG. *3a* is a schematic drawing illustrating the height adjusting device with the stop block engaged;

FIG. *3b* is a schematic drawing illustrating the height adjusting device with the stop block disengaged;

FIG. 4 is a schematic drawing illustrating a pneumatic loop according to the present invention;

FIG. 5 illustrates a circuit block diagram according to the present invention;

FIG. 6 is an enlarged sectional view of the rack and gear wheel portion of the height adjusting device; and, FIG. 7 is a sectional view taken along the section line A—A of FIG. *2b*.

DESCRIPTION OF THE PREFERRED EMBODIMENTS

Figure 1:
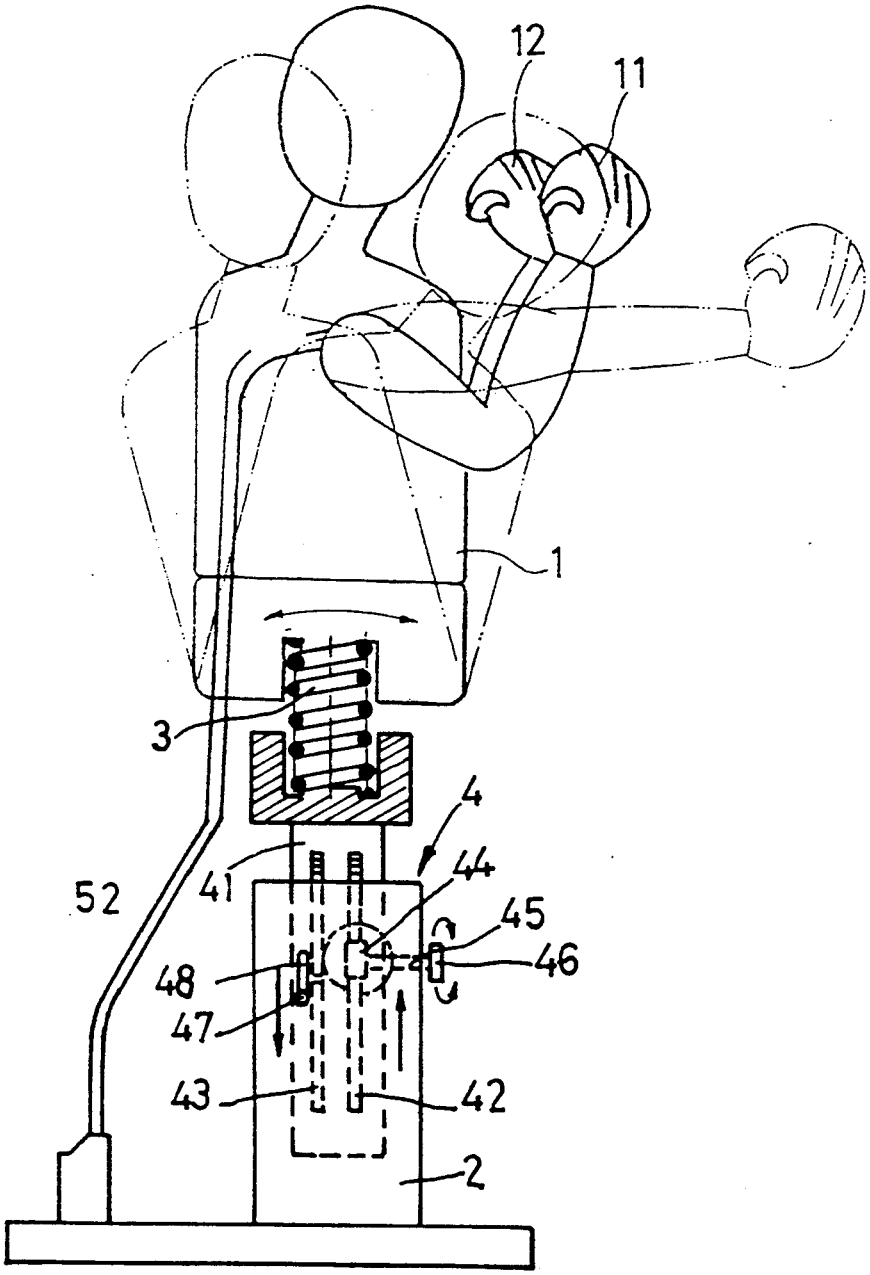
FIG. 1 is a structural schematic view of a boxing training partner embodying present invention.
Figure 2A:
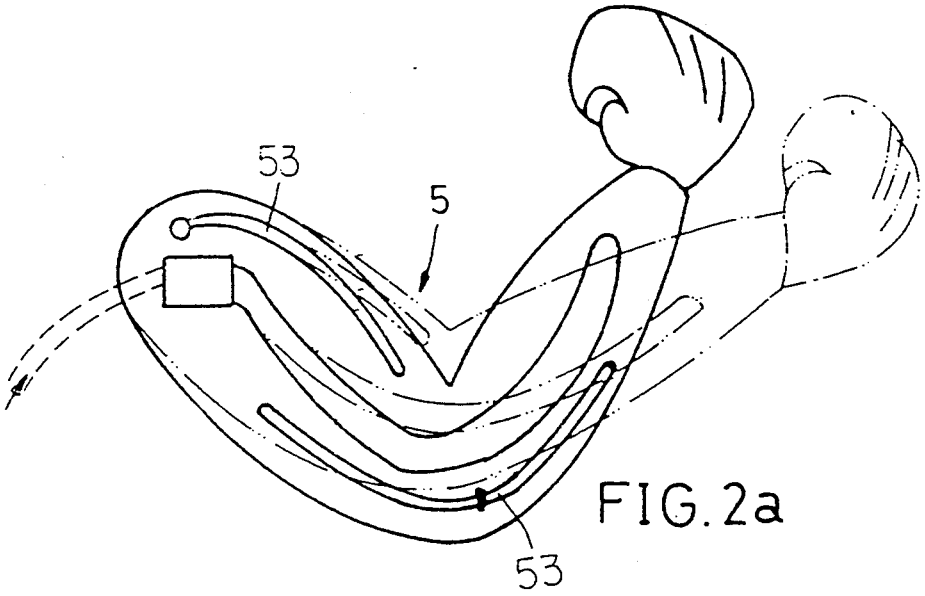
Figure 2B:
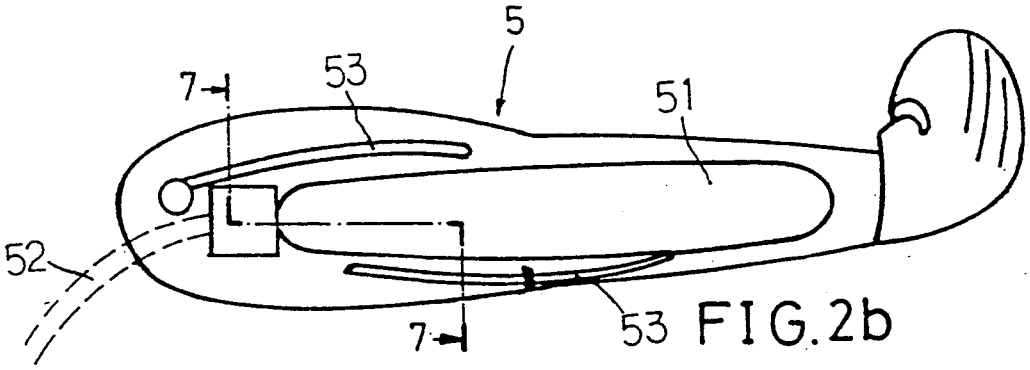

Referring to FIGS. 1 and 2, a boxing training partner of the present invention is generally comprised of a figure body 1, a base 2, a spring 3, a height adjusting device 4, two arm extension devices 5, and a controller 6. The figure body 1 includes two arms 11 and 12 and is stuffed with suitable stuff materials in the head portion and the whole body portion to protect against socks. The height adjusting device 4 is located within the base 2. The spring 3 is disposed between the figure body 1 and the base 2 with the upper end received inside the figure body 1 and the bottom end received in a linking block 41 fixedly mounted on the height adjusting device 4. Through the effect of the spring 3 and the height adjusting device 4, the figure body 1 is permitted to swing in all directions and to be moved up and down.

The two arm stretching devices 5 are respectively located within the two arms 11 and 12.

Figure 3B:
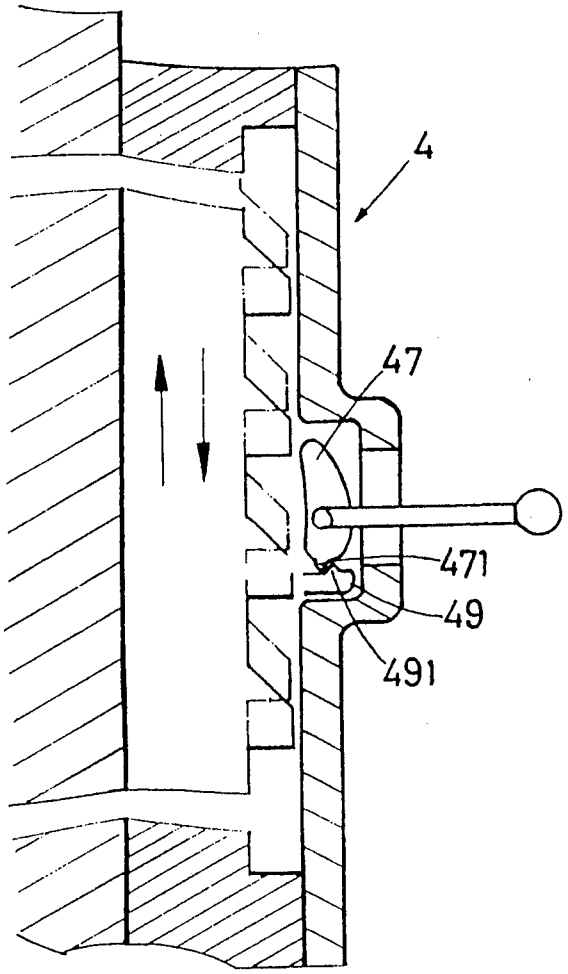
Figure 3A:
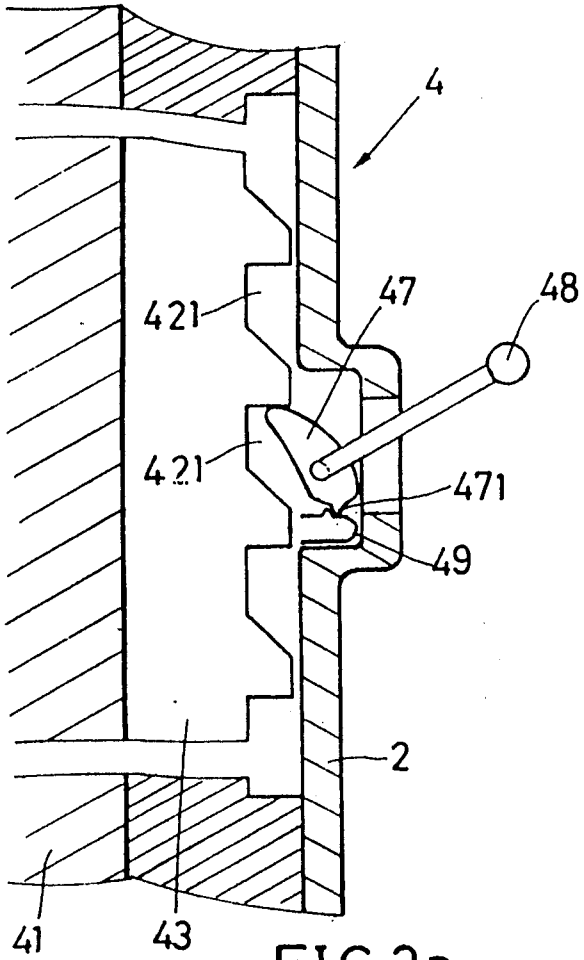

Referring additionally to FIG. 3, the height adjusting device 4 is shown to include a linking block 41 having two longitudinal racks 42 and 43 formed on one side thereof, a gear wheel 44 engaged with the rack 42, and a transmission rod 45 connected to the gear wheel 44 and extending outward through the base 2. A knob 46 is mounted on the end of transmission rod 45 extending through base 2, for controlling the rotation of the gear wheel 44 through the transmission rod 45 to move the rack 42 relative to base 2. A stop block 47 is movably seated in engagement with the teeth 421 of the rack 43. A control lever 48 is coupled to the stop block 47 and extends outward through the base 2 for disengaging stop block 47 from the teeth 421. Stop block 47 pivots on a spring plate 49 disposed at the bottom of the stop block 47. When the stop block 47 is engaged with the teeth 421 of the rack 43, the height of the figure body 1 is fixed thereby. If it is desired to change the height of the figure body 1, the user displaces the control lever 48, with one hand, whereby a projecting end 471 of the stop block 47 is displaced from the raised portion 491 of the spring plate 49, releasing the stop block 47 from the constraint of the spring plate 49 and disengaging stop block 47 from the teeth 421 of the rack 43. Then, the knob 46 is rotated with the other hand to rotate the gear wheel 44 by way of the transmission rod 45, thereby displacing the rack 42 and the linking block 41 with it. Thus, the figure body 1 can be positioned at a preferred height, which is maintained by returning the stop block 47 to its original position for reengagement with the teeth 421 of rack 43.

Referring to FIG. 2, the arm extending device 5 includes an elongated gas bag 51 respectively located inside each of the two arms 11 and 12. Each of the two elongated gas bags 51 comprises an air hole 511 disposed at the rear end thereof, and is fluidly coupled to the controller 6 through a gas pipe 52. Two elongated arch spring plates 53 are positioned within each of the two arms 11 and 12. The position of the two elongated arch spring plates 53 in each arm 11 or 12 is most preferably arranged such that one is located at an upper position, inside the upper arm region, and the other is located at a lower position outside the elbow region. The interior of arms 11 and 12, outside the elongated gas bags 51 is filled with a stuffing material 54.

The two arm extending devices 5 are controlled by the controller 6. As illustrated in FIG. 4, air source A is delivered through electromagnetic valve B and pressure regulator valve C to provide an air pressure to a respective one of the elongated gas bags 51. Through the effect of the air pressure, the elongated gas bag 51 immediately overcomes the force of the two elongated arch spring plates 53 to extend the respective arm 11 or 12. The air pressure is subsequently exhausted from the gas bag 51 through exhausting device D. After exhaustion of the air from gas bag 51, the elongated arch spring plates 53 return to original arch shape, through the effect of their elastic resilient property, to drive the respective arm 11 or 12 to contract. Through an aperiodic extension and contraction of the two arms 11 and 12, the present invention can efficiently act as a sparring partner for boxing training.

Referring to FIGS. 4 and 5, there is shown, the circuit controller for switching, on or off, of the magnetic valves for each of arms 11 and 12, thereby causing the air pressure from source A to be passed or blocked.

Under the control of the electromagnetic valve B, the air pressure enters regulator valve C wherein the air pressure is regulated to a predetermined pressure, to adjust the strength of boxing to be obtained. The regulated air pressure entering air bag 51 in a respective arm overcomes the spring force of the spring plates 53 to extend out the arm 11, 12 as if boxing. When the magnetic valve 6 is turned off, air pressure is stopped at once, and the arm is brought back to a normal retracted state by the spring force of the two spring plates 53, simultaneous with the release of air pressure from the air bag 51 through the release valve D. Thus reciprocation of a boxing action is completed by the repeated extension and retraction of the arms.

Referring to the circuit diagram of the present invention, as illustrated in FIG. 5, there is shown, an oscillator (OSC) for generating clock pulse signals, the frequency of which is variable. The oscillator is coupled to an address counter, which in turn is coupled to a programmable memory (PROM) for data storage. The memory adress obtained from the counter defines a predetermined data output which is coupled to a respective NAND Gate so as to control the left or right arm. The output of a respective NAND Gate is couled to a buffer device, such as a relay, to drive the electromagnetic valve B. A power supply is included which provides electric power for supplying electrical energy to the elements of the circuit and the electromagnetic valve.

The aforedescribed system provides a boxing training partner, wherein the timing to produce a left blow or right blow, by extension and retraction of a respective arm, can be flexibly controlled by the on/off signals stored in the memory of the controller. The strength of blow can be adjusted by setting the air supplied to the air bag to a predetermined pressure with a pressure regulator valve of the controller. The total height of the training partner can be adjusted through a height adjusting device disposed in base of the unit, to accommodate the body size of a player.

We claim:

1. A boxing training partner, comprising:

a figure body having a pair of arm members;

a hollow base;

a spring disposed between said figure body and said base, said spring having an upper end coupled to said figure body;

a height adjusting means disposed within said base for vertically positioning said figure body, said height adjusting means including (1) a linking block coupled on one end thereof to a lower end of said spring, (2) a pair of toothed racks coupled to a surface of said linking block in spaced parallel relation, (3) a gear wheel meshingly engaged with one of said racks, (4) a knob rotatively coupled to said gear wheel, (5) a stop block releasably engaged with a tooth of the other of said racks, and (6) a control lever coupled to said stop block for releasing said engagement of said stop block with said rack;

means for reciprocatingly displacing said arms, said reciprocating means including (1) a pair of elongated gas bags, each of said pair of gas bags being disposed in a respective one of said pair of arms, and (2) a pair of arched spring plates disposed in each of said arms; and, controller means fluidally coupled to each of said gas bags for extending one of said arms responsive to inflation of a respective one of said gas bags to overcome a spring force of a respective pair of said spring plates, and subsequently retracting said arm responsive to deflation of said gas bag and said spring force of said pair of spring plates, said controller means aperiodically inflating said gas bags responsive to a predetermined sequence.

* * * * *